United States Patent [19]

Johnson

[11] 3,946,460

[45] Mar. 30, 1976

[54] RELEASABLE DOOR STOP AND STRIKE PLATE ASSEMBLY FOR A BIDIRECTIONAL SWINGING DOOR

[75] Inventor: Larry K. Johnson, Sterling, Ill.

[73] Assignee: Lawrence Brothers, Inc., Sterling, Ill.

[22] Filed: May 21, 1974

[21] Appl. No.: 472,067

[52] U.S. Cl. ..... 16/82; 49/141; 292/228; 292/341.17; 292/DIG. 65

[51] Int. Cl.[2] ..... E05F 5/02

[58] Field of Search ..... 16/82; 49/141, 400; 292/219, 228, 341.17, 304, DIG. 65

[56] References Cited

UNITED STATES PATENTS

| | | | |
|---|---|---|---|
| 1,530,672 | 3/1925 | Hoffman | 292/341.17 X |
| 2,312,352 | 3/1943 | Mickler | 292/341.15 X |
| 3,105,992 | 10/1963 | Carlson | 49/141 X |
| 3,172,168 | 3/1965 | Suska | 49/400 |
| 3,811,719 | 5/1974 | McBurnie | 292/219 X |

*Primary Examiner*—Kenneth Downey
*Attorney, Agent, or Firm*—Olson, Trexler, Wolters, Bushnell & Fosse, Ltd.

[57] ABSTRACT

The embodiment of the invention disclosed herein is directed to a door stop assembly for a bidirectional swinging door to permit opening the door in a first direction during normal use and to permit selective opening of the door in a second direction during an emergency. The stop is employed in an assembly which includes a face or strike plate having an opening for receipt of a strike member, a housing formed on one side thereof, all adapted to be set in a mortise of a door frame. The door stop assembly has a floating body member which moves linearly inwardly into the housing and then engages the back wall thereof and rocks about a sloping inclined surface of the body portion so that the stop engaging surface of the stop assembly is displaced from engagement with the door, thereby permitting the door to be opened in the opposite direction of its normal use.

8 Claims, 5 Drawing Figures

RELEASABLE DOOR STOP AND STRIKE PLATE ASSEMBLY FOR A BIDIRECTIONAL SWINGING DOOR

BACKGROUND OF THE INVENTION

This invention relates generally to improvements in the structure of stop assembly mechanisms for use with bidirectional swinging doors such as those used in hospitals, and more particularly to a stop assembly mechanism and its combination with a striker plate for a door lock that provides substantial useful improvements over existing stop assemblies which are now commonly used. While the stop assembly of the invention disclosed herein is intended for use primarily in hospitals and other areas where it is desirous to obtain access to rooms, such as wash rooms and the like, during an emergency condition, it will be understood that the stop assembly may be used for other purposes.

Heretofore, stop assembly devices for bidirectional swinging doors have been provided so that doctors and nurses can gain access to wash rooms wherein patients may have collapsed, as shown in U.S. Pat. Nos. 3,172,168 and 2,899,571. Such bidirectional swinging doors have been devised so that actuation of the stop mechanism releases the door so that it can be opened in the opposite direction from its normal use during this emergency condition. The need for such bidirectional operation of doors is readily apparent when considering, for example, elderly patients who may have an attack while in the wash room and collapse against the inside of the door. Therefore, even if the lock mechanism was released, pushing the door open in its normal direction might be precluded and could cause further injury to the patient as the door would push against the patient. Therefore, it is advantageous to pull the door open in the opposite direction.

Door stop assemblies for bidirectional swinging doors as disclosed above generally include a pivotal element which protrudes from the door frame opposite that receiving the door hinges so that the edge of the door engages the stop element. Should access to the wash room or other room be desirous from the outside, a stop element is pivoted into the door frame and the door is then readily opened in the opposite direction. One problem of stop elements which are pivotally mounted to their support units is that actual use of the bidirectional feature of the door is relatively infrequent, and these may freeze or bind before they are ever used. In fact, some bidirectional swinging doors utilizing the stop elements may never be operated during their entire life. Because of the high degree of cleanliness required in hospitals, soap and water washing of the walls, ceilings and doorways is a relatively frequent occurrence. While the components incorporated in the door stop assembly may be of stainless steel or some other non-rusting metal, they still may corrode or otherwise oxidize. Should the pivot pin rust in position, it would be extremely difficult to depress the stop mechanism into the door frame so that the door can be opened in the opposite direction. As mentioned above, even if the components of the stop mechanism are made of substantially rustproof materials, the pivot pin to which the door stop is secured may stick due to dirt or other gummy substances which may accumulate therein as the result of detergent or soap and water cleaning.

SUMMARY OF THE INVENTION

Accordingly, it is an object of this invention to provide a new and improved stop assembly device for bidirectional swinging doors which cannot rust or stick in the stop position, thereby insuring that the stop device will be operable at all times.

Another object of this invention is to provide a new and improved stop assembly for bidirectional swinging doors which has a floating body member forming the stop element which moves linearly inwardly and then rocks about an inclined surface, thereby eliminating the need for pivotal movement or pivot connections or the like.

Still another object of this invention is to provide a door stop assembly for bidirectional swinging doors which includes an opening formed therein to receive the door latch mechanism, thereby providing a striker plate in combination therewith.

Briefly, the door stop assembly of this invention includes a face plate adapted to be fastened to the doorway frame opposite that carrying the bidirectional hinges for the door. The face plate includes an aperture formed therein and means are provided to secure a housing opposite the aperture to retain a floating member which functions as the stop element. Also formed on the face plate is an opening which receives the door latch mechanism and thereby forming a striker plate for the door. The floating body member is biased outwardly so that oppositely directed flanges formed thereon engage the inner surface of the plate member and prevent the body member from coming out of its housing position. The floating body member is spring-biased and mounted in such a manner so as to allow only linearly inwardly depression or movement initially, until the body member bottoms against an opposite wall of the housing. Once the body member is in this position it is rocked forward so that an inclined surface then engages the wall of the housing completely removing the stop element from position for engagement by the door. The door can then be opened in the opposite direction.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENT

Figure 1:
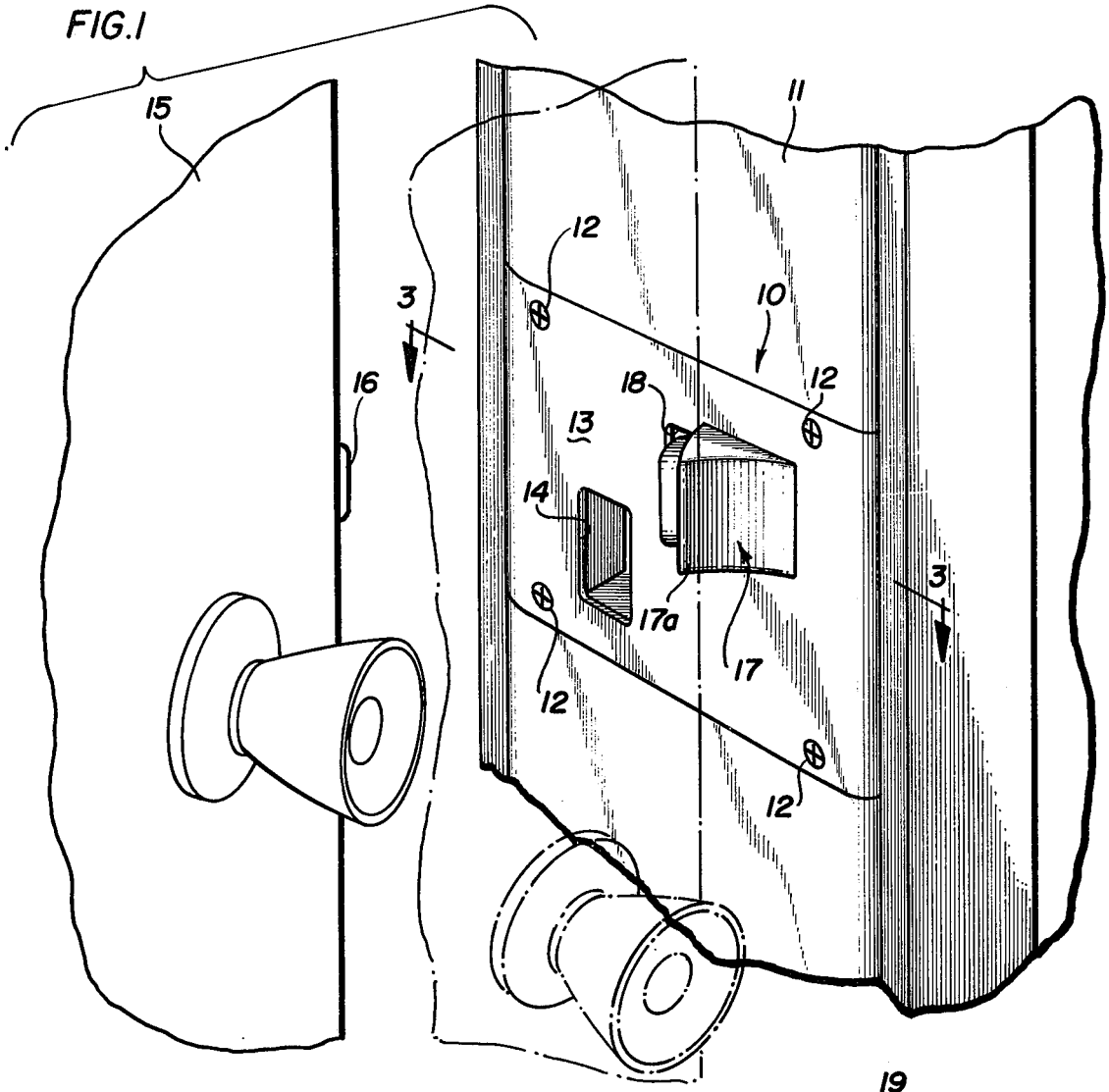
FIG. 1 is a fragmentary perspective view of a door, door frame and stop assembly constructed in accordance with the principles of this invention.

Referring now to FIG. 1, there is seen a door stop assembly constructed in accordance with the principles of this invention and designated generally by reference numeral 10. The door stop assembly 10 is adapted to be fastened to a door frame designated generally by reference numeral 11 by a plurality of screws 12 located near the four corners of a face plate element 13.

Most advantageously, the face plate element 13 has an opening 14 formed therein to receive a latch mechanism 16 when the door is closed, as seen in phantom lines. Thus, in one installation there is provided an emergency release stop and the strike plate.

Figure 2:
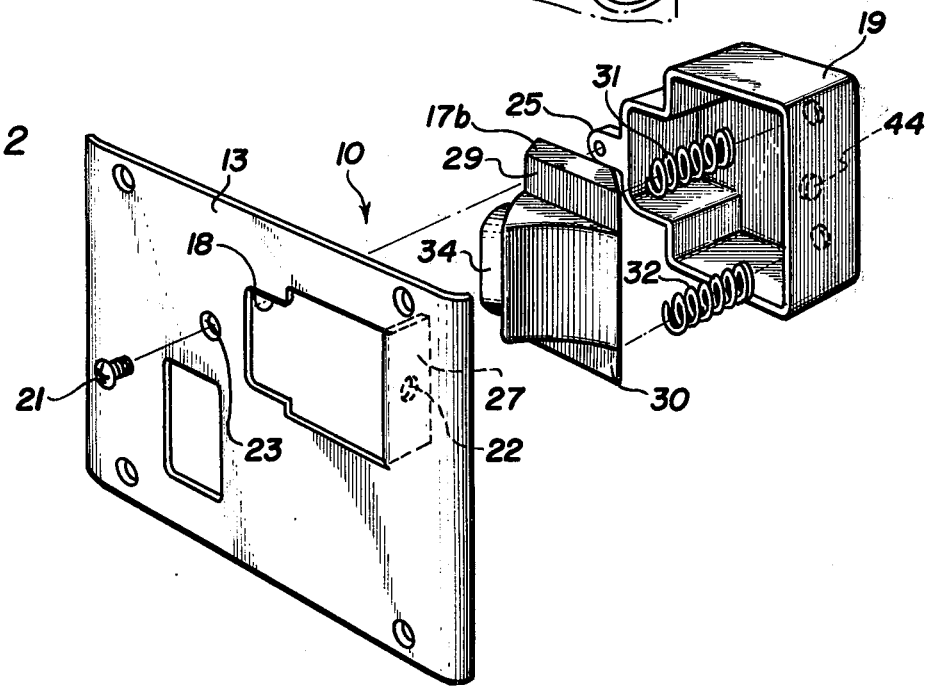
FIG. 2 is an exploded view of the stop assembly constructed in accordance with the principles of this invention.

The stop assembly 10 further includes a floating body or stop member 17 which has a portion thereof 17*a* extending through an aperture 18 formed in the face plate 13 and a second portion 17*b* positioned within a housing 19, as seen in FIG. 2. The floating body member 17 moves freely inwardly within the housing 19 without any type of pivotal mounting.

The housing 19 is secured to the back side of the face plate 13 by one or more screws 20 and 21 passing through openings 22 and 23, respectively, to engage threaded portions 24 and 25, respectively, of the housing 19. In the illustrated embodiment the opening 22 is formed in a struck-out bend-over portion 27 formed of the same material formed on the face plate 13.

The floating body member 17 has diametrically opposed flange portions 29 and 30 formed as part of the second portion 17 to extend beyond the edges of the aperture 18 and engage the rear surface of the face plate 13. These flange members maintain the floating body member within the housing 19. To provide outward bias of the floating body member 19 a pair of coil springs 31 and 32 are positioned within the housing and engage recesses within the movable body member 17 and protuberances within the housing 19. The recesses and protuberances maintain the spring members 31 and 32 in their desired position while allowing free movement of the floating body member inwardly within the housing.

Figure 3:
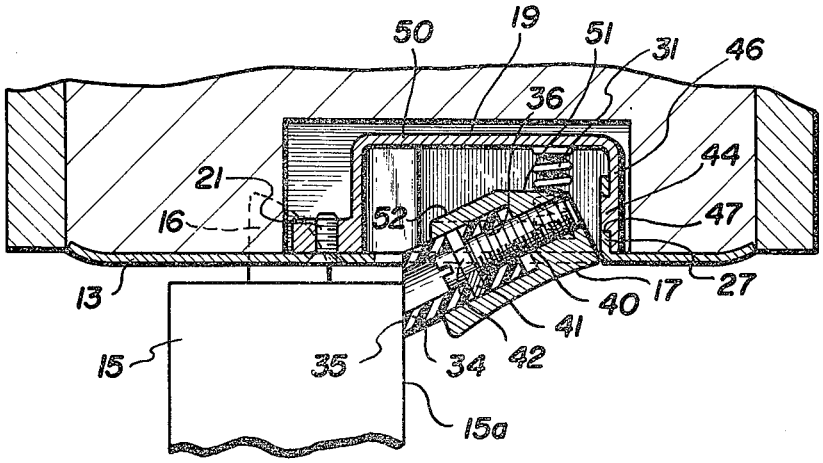
FIG. 3 is a top sectional view of the stop assembly of this invention as taken along line 3—3 of FIG. 1.

Most advantageously, an adjustable resilient stop element 34 is threadedly adjustably secured to the portion 17*b* and angled outwardly therefrom to provide a flat parallel stop surface against which the door engages. This is best seen in FIG. 3. The stop element 34 has a front face 35 formed on a bias, so as to engage the door in flush, face-to-face engagement. The purpose for this will become apparent from the preceding description.

FIG. 3 illustrates the door stop assembly of this invention in its normal position having the stop bumper element 34 with the front face 35 thereof engaging the surface 15*a* of the door 15. As can also be seen in FIG. 3, the stop element 34 is received in a recess 36 in the floating body member 17 and is attached thereto by a screw element 40 threadedly engaged therewith. A retainer ring 41 is carried by the stop element 34 and is engaged in a groove 42 formed adjacent the head of the screw 40, thus fixing the relative position of screw 40 and stop element 34. Operation of the screw 40 will thus produce movement of the stop 34 inwardly or outwardly of the recess 36, permitting adjustment of the relative position of said stop.

The above-mentioned adjustment is advantageous from a number of standpoints. First, should the element

34 become worn, it can be moved outwardly to maintain engagement with the door surface 15*a*. Where no adjustment is provided, the stop may become worn in service and result in rattling of the door. Secondly, this adjustable feature aids in the initial installation. In this regard, it is not necessary that precise positioning of the stop device be effected initially, as the position of the bumper 34 can be adjusted to accommodate variances.

It will be recalled that the stop element 34 is provided with a flat surface 35 engaged against the door surface 15*a* in flush, face-to-face engagement. As such, in the position illustrated in FIG. 3, the floating member 17 can only move linearly inward of the aperture 18 due to this flush engagement of the stop element 34 with the door.

Also seen in FIG. 3 is an alternate form of fastening the housing portion 19 to the face plate 13. In this instance a protuberance 44 is provided on a side wall 46 of the housing 19, which protuberance engages an aperture 47 formed in the struck-out bend-over portion 27.

Figure 4:
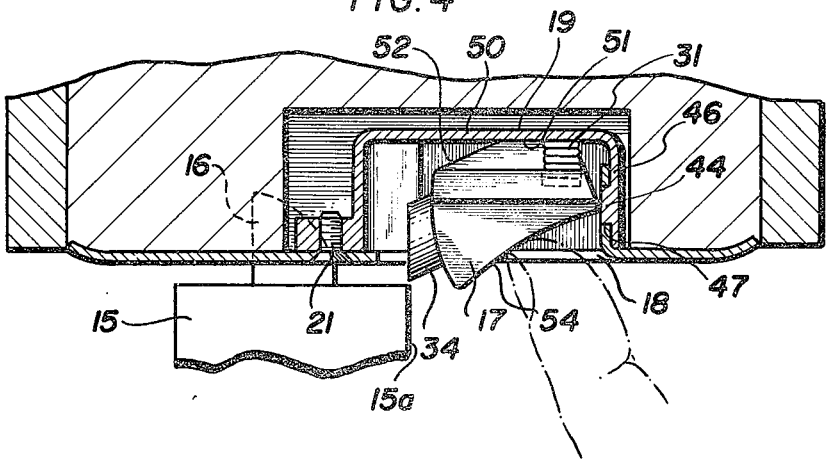
FIG. 4 is a top sectional view similar to that of FIG. 3 and shows the initial linear inward movement of the floating body member forming the stop element.

The housing 19 has a back wall 50 thereof positioned a predetermined distance behind the aperture 18 through which the floating body member 17 extends. When it is desirous to open the door 15 in the opposite direction from its normal use, the floating body member 17 is pressed inwardly into the housing 19 until the flat surface 51 thereof engages the wall 50. This initial movement will produce the condition as illustrated in FIG. 4. As mentioned above, due to the flush engagement of stop surface 35 with the door only linear movement is possible upon depression of the floating body 17 to the position of FIG. 4. When the surface 51 bottoms on wall 50, all or the major portion of stop element 34 is disengaged from the door surface 15*a*, as seen in FIG. 4. Even if a slight degree of engagement remains as seen in FIG. 4, the portion of stop element 34 still engaged with the door is quite flexible and will permit operations as discussed hereinafter.

Figure 5:
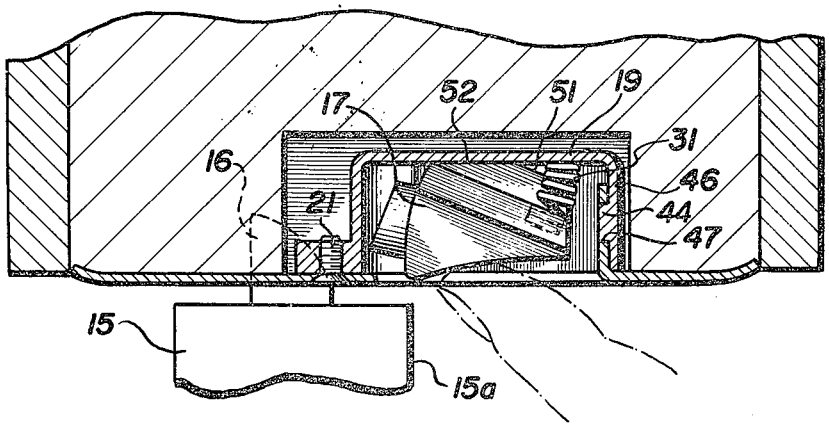
FIG. 5 is a top sectional view similar to that of FIG. 4 illustrating the floating body member rocked about an inclined surface formed thereon.

Once the body member 17 is seated on the wall 50, the entire element 17 is rocked forward, as shown in FIG. 5. This movement will bring the inclined surface 52 into engagement with wall 50 while depressing the remainder of the body 17 interiorly of the aperture 18. When the above occurs, the door 15 may be opened in the aforesaid opposite direction and safely operated.

With further reference to FIG. 5, when the stop element is rocked forward to engage surface 52 with the wall 50, the tapered surface 54 on the stop is brought to a generally flush position relative to plate 13. Accordingly, during opening of door 15 in said opposite direction, there is no danger that the operator's finger will become pinched between the door edge and the edge of opening 18.

Further, once the emergency is over, resetting of the door 15 is quite easy. As the door swings back to its original position it will engage aforementioned tapered surface 54. This engagement will produce the operation essentially as shown in FIGS. 4 and 5, in that the body 17 will move inwardly and then will rock to permit the door to pass the stop and arrive at its original position.

Thus, it is believed clear that there is provided an emergency release stop which is not subject to becoming inoperative or stuck during long periods of non-use, yet this device of the present invention provides a safe, reliable stop that can be easily operated.

While a single specific embodiment of the invention has been disclosed herein, it will be understood that variations and modifications may be effected without departing from the spirit and scope of the novel concepts as defined in the following claims.

The invention is claimed as follows:

1. A door stop assembly for a bidirectional swinging door to permit opening of said door in a first direction during normal use while enabling selective opening of said door in a second direction during an emergency situation, said assembly comprising, in combination: a face plate adapted to be fastened to a doorway frame and having an aperture formed therein; housing means associated with said face plate in registry with said aperture for insertion into a mortise formed in a doorway frame, said housing means having an inner wall opposite said aperture in said face plate; a stop member movably carried within said housing means, said stop member being free from pivotal mounting on said housing means or said face plate, thereby constituting said stop member a free floating member, said free floating stop member having a first portion extending through said aperture of said face plate to provide a stop surface for a door being closed in the normal direction of movement, said first portion further including an inclined surface facing oppositely of said stop surface, and a second portion within said housing; means for maintaining said free floating stop member in assembly with said housing; biasing means positioned between said free floating stop member and said inner wall of said housing means to urge said first portion outwardly of said housing in blocking relation to said door; the surface of said second portion facing said inner housing wall being configured such that upon manual depression of said free floating member, said surface will first bottom on said inner housing wall, with said free floating stop member then rocking forward to dispose said stop surface entirely within said aperture, thereby permitting opening of said door in said second direction, said rocking movement positioning said inclined surface on said first portion at substantially the level of said aperture to preclude pinching the finger of the operator between said door and said aperture when said door is moved past said free floating stop member.

2. A door stop assembly for a bidirectional swinging door to permit opening of a door in a first direction during normal use and to permit selective opening of the door in a second direction during an emergency, comprising in combination: a face plate adapted to be fastened to a doorway frame having an aperture formed therein, housing means associated with said face plate in registry with said aperture for insertion into a mortise formed in the doorway frame receiving the same, said housing means having an inner wall opposite said aperture in said face plate, a stop member movably carried within said housing means, said stop member being free from pivotal mounting on said housing means or said face plate, thereby constituting said stop member a floating member, said floating stop member having a first portion extending through said aperture of said face plate to provide a stop surface for a door when being closed in the normal direction, and a second portion within said housing including means overlying the periphery of said aperture to maintain said floating stop member within said housing, and biasing means positioned between said floating stop member and said inner wall of said housing means to urge said first portion of said floating stop member outwardly, said surface of said portion of said floating stop member facing said inner housing wall has a first flat surface substantially parallel to said inner wall and leading into and contiguous with a second flat surface inclined with respect thereto, said first flat surface engaging said inner wall upon linear movement of said floating stop member into said housing partially to displace said stop surface with said stop member rocking about the juncture of said contiguous flat inclined surfaces to bring said second surface into engagement with said inner wall, thereby completely to displace said stop surface from the path of said door.

3. The door stop assembly for a bidirectional swinging door as set forth in claim 2 wherein said biasing means includes a pair of coil springs each having one end inserted into a recess formed in said first flat surface of said second portion of said floating stop member.

4. The door stop assembly for a bidirectional swinging door as set forth in claim 2 wherein said first portion of said floating stop member has a sloping surface extending in the opposite direction of said stop surface to allow the door freely to swing back to its normal position when opened in the second direction during an emergency.

5. The door stop assembly for a bidirectional swinging door as set forth in claim 1 wherein said face plate has a second opening formed therein to receive the spring latch element of the door to provide a striker plate therefor, said second opening being offset vertically relative to said first opening such that it can receive said latch element when said door is engaged against said stop surface.

6. A door stop assembly for a bidirectional swinging door to permit opening of a door in a first direction during normal use and to permit selective opening of the door in a second direction during an emergency, comprising in combination: a face plate adapted to be fastened to a doorway frame having an aperture formed therein, housing means associated with said face plate in registry with said aperture for insertion into a mortise formed in the doorway frame receiving the same, said housing means having an inner wall opposite said aperture in said face plate, a stop member movably carried within said housing means, said stop member being free from pivotal mounting on said housing means or said face plate, thereby constituting said stop member a floating member, said floating stop member having a first portion extending through said aperture of said face plate to provide a stop surface for a door when being closed in the normal direction, and a second portion within said housing including means overlying the periphery of said aperture to maintain said floating stop member within said housing, and biasing means positioned between said floating stop member and said inner wall of said housing means to urge said first portion of said floating stop member outwardly, said floating stop element having a recess formed therein angled outwardly in the direction of the door and terminating in said first portion and including a resilient bumper element inserted in said recess, said resilient bumper element forming said stop surface, and having a retainer formed therein which receives a reduced diameter portion of a threaded shaft, the threaded end of said shaft being engaged with a threaded passage within said recess to provide adjustment of the position of said resilient bumper.

7. A door stop assembly for a bidirectional swinging door to permit opening of a door in a first direction during normal use and to permit selective opening of the door in a second direction during an emergency, comprising in combination: a face plate adapted to be fastened to a doorway frame and having an aperture formed therein, said face plate having an opening formed therein to receive the spring latch element of the door to provide a striker plate therefor, housing means associated with said face plate in registry with said aperture for insertion into a mortise formed in the doorway frame receiving the same, said housing means having an inner wall opposite said aperture in said face plate, a stop member movably carried within said housing means, said stop member being free from pivotal mounting on said housing means or said face plate, thereby constituting said stop member a floating member, said floating stop member having a first portion extending through said aperture of said face plate to provide a stop surface for a door when being closed in the normal direction, and a second portion within said housing and including means overlying the inner periphery of said aperture to maintain said floating stop member within said housing, said second portion of said floating stop member has a first flat surface substantially parallel to said inner wall and leading into a contiguous with a second flat surface inclined with respect to said first surface, said first flat surface being brought into engagement with said inner wall upon initial linear movement of said floating stop member inwardly of said housing partially to displace said stop surface and said stop member rocking about the juncture of said flat surfaces to bring said second flat surface into engagement with said inner wall completely to displace said stop surface from engagement with the door, said floating stop member having a recess formed therein angled outwardly in the direction of the door and terminating in said first portion and including a resilient bumper element inserted in said recess, said resilient bumper element forming said stop surface, said resilient bumper element having a retainer formed therein to receive a reduced diameter portion of a threaded shaft and wherein said threaded shaft engages a threaded passage within said recess to provide adjustment of the position of said resilient bumper, and spring bias means positioned between said floating stop member and said inner wall to urge said first portion of said floating stop member outwardly, whereby emergency opening of the door is accomplished by manually depressing said floating stop member into said housing and effecting rocking thereof thereby removing the stop surface from engagement with the door.

8. The door stop assembly as defined in claim 2 wherein said first portion of the floating stop member includes a surface extending in a direction opposite of the stop surface, such that when the stop member is rocked to bring the second surface into engagement with the inner wall of the housing, said oppositely facing surface will be disposed proximate said face plate aperture to prevent an operator's finger from being pinched between the door and said aperture periphery, when said door is opened in said second direction.

* * * * *

UNITED STATES PATENT OFFICE

CERTIFICATE OF CORRECTION

Patent No. 3,946,460 Dated MARCH 30, 1976

Inventor(s) Larry K. Johnson

It is certified that error appears in the above-identified patent and that said Letters Patent are hereby corrected as shown below:

Col. 1, line 24, "2,899,571" should be --2,889,571--

Col. 7, line 26, "a" should be --and--

Signed and Sealed this

Sixth Day of July 1976

[SEAL]

*Attest:*

RUTH C. MASON
*Attesting Officer*

C. MARSHALL DANN
*Commissioner of Patents and Trademarks*